US011959471B2

(12) United States Patent
Raymond et al.

(10) Patent No.: US 11,959,471 B2
(45) Date of Patent: Apr. 16, 2024

(54) PERISTALTIC PUMP HAVING TEMPERATURE-COMPENSATED VOLUMETRIC DELIVERY

(71) Applicant: Waters Technologies Corporation, Milford, MA (US)

(72) Inventors: Timothy M. Raymond, Boston, MA (US); Sean Eric Anderson, Dedham, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 17/865,960

(22) Filed: Jul. 15, 2022

(65) Prior Publication Data

US 2023/0028806 A1 Jan. 26, 2023

Related U.S. Application Data

(60) Provisional application No. 63/225,243, filed on Jul. 23, 2021.

(51) Int. Cl.
*F04B 43/00* (2006.01)
*F04B 43/12* (2006.01)
(Continued)

(52) U.S. Cl.
CPC ..... *F04B 43/0081* (2013.01); *F04B 43/12* (2013.01); *F04B 49/065* (2013.01); *F04B 49/20* (2013.01); *F04B 2207/03* (2013.01)

(58) Field of Classification Search
CPC ..... F04B 43/12; F04B 43/0081; F04B 49/20; F04B 2207/03
See application file for complete search history.

(56) References Cited

U.S. PATENT DOCUMENTS 5,018,945 A * 5/1991 D'Silva ..... A61M 5/14228 417/474
6,114,122 A 9/2000 Besemer et al.
(Continued)

FOREIGN PATENT DOCUMENTS

CA 3054707 A1 7/2011
CA 2787660 C 9/2019
(Continued)

OTHER PUBLICATIONS

International Search Report and Written Opinion in PCT/US2022/037288 dated Oct. 5, 2022.
(Continued)

*Primary Examiner* — Christopher S Bobish
(74) *Attorney, Agent, or Firm* — Schmeiser, Olsen & Watts LLP; William G. Guerin

(57) ABSTRACT

Described is a method for regulating a volume of liquid delivered by a peristaltic pump and a peristaltic pump system that can be used to perform the method. The method includes sensing an ambient temperature of the peristaltic pump. The peristaltic pump includes a pump motor. At least one of a motor speed and a motor operation duration is determined from the sensed temperature, a selected volume of liquid to be delivered and a predetermined correspondence of the motor speed to ambient temperature. The pump motor is operated at the determined motor speed or for the determined motor operation duration to deliver the selected volume of liquid from the peristaltic pump.

15 Claims, 6 Drawing Sheets

(51) Int. Cl.
*F04B 49/06* (2006.01)
*F04B 49/20* (2006.01)

(56) References Cited

U.S. PATENT DOCUMENTS

| | | | | |
|---|---|---|---|---|
| 6,391,623 | B1 | 5/2002 | Besemer et al. | |
| 6,503,221 | B1 * | 1/2003 | Briggs | F04B 43/08 604/67 |
| 6,869,425 | B2 * | 3/2005 | Briggs | G05D 7/0676 604/500 |
| 7,186,382 | B2 | 3/2007 | Schrenk et al. | |
| 7,282,183 | B2 | 10/2007 | Peck | |
| 8,297,936 | B2 | 10/2012 | Witt et al. | |
| 8,715,224 | B2 | 5/2014 | Kamen et al. | |
| 9,435,773 | B2 | 9/2016 | Glatz et al. | |
| 9,457,143 | B2 | 10/2016 | Kamen et al. | |
| 9,583,160 | B1 | 2/2017 | Pekny | |
| 11,705,233 | B2 * | 7/2023 | Kamen | G01F 1/666 417/63 |
| 2002/0147425 | A1 * | 10/2002 | Briggs | F04B 43/08 604/65 |
| 2011/0313351 | A1 | 12/2011 | Kamen et al. | |
| 2013/0177455 | A1 | 7/2013 | Kamen et al. | |
| 2014/0243739 | A1 | 8/2014 | Kamen et al. | |
| 2015/0322939 | A1 * | 11/2015 | Katase | F04B 43/1223 417/474 |
| 2017/0021094 | A1 | 1/2017 | Kamen et al. | |
| 2017/0069362 | A1 | 3/2017 | Pekny | |
| 2020/0018306 | A1 * | 1/2020 | Leach | G05D 7/0676 |
| 2021/0338922 | A1 | 11/2021 | Uber, III et al. | |
| 2021/0340969 | A1 | 11/2021 | Bartels et al. | |
| 2022/0080117 | A1 | 3/2022 | Ding et al. | |
| 2022/0126005 | A1 | 4/2022 | Friederichs et al. | |
| 2022/0152299 | A1 | 5/2022 | Juretich et al. | |
| 2022/0243721 | A1 * | 8/2022 | Pham | F04B 49/103 |

FOREIGN PATENT DOCUMENTS

| | | | |
|---|---|---|---|
| CA | 3054707 | C | 6/2022 |
| EP | 1264637 | A1 | 12/2002 |
| EP | 0988451 | B1 | 1/2005 |
| EP | 1264637 | B1 | 4/2006 |
| EP | 2438435 | B1 | 8/2014 |
| EP | 2525844 | B1 | 12/2017 |
| EP | 3477112 | A1 | 5/2019 |
| EP | 3715632 | A1 | 9/2020 |
| EP | 3662945 | B1 | 7/2022 |
| WO | 1998057064 | A1 | 12/1998 |
| WO | 2010139359 | A1 | 12/2010 |
| WO | 2011091246 | A2 | 7/2011 |
| WO | 2012093370 | A1 | 7/2012 |
| WO | 2016012072 | A1 | 1/2016 |

OTHER PUBLICATIONS

International Preliminary Report on Patentability in PCT/US2022/037288 mailed on Feb. 1, 2024.

* cited by examiner

PERISTALTIC PUMP HAVING TEMPERATURE-COMPENSATED VOLUMETRIC DELIVERY

RELATED APPLICATION

This application is a non-provisional patent application claiming priority to U.S. Provisional Patent Application No. 63/225,243, filed Jul. 23, 2021, titled "Peristaltic Pump Having Temperature-Compensated Volumetric Flow Rate," which is incorporated herein by reference.

FIELD OF THE INVENTION

The disclosed technology relates generally to peristaltic pumps. More particularly, the technology relates to a peristaltic pump having a temperature-compensated volumetric delivery.

BACKGROUND

The volumetric flow rate of a peristaltic pump is dependent on the peristaltic tubing dimensions, motor operating speed, and tubing mechanical properties. Variations in ambient temperature causes the mechanical properties of the peristaltic tubing to change. Consequently, changes in ambient temperature can cause variations in the volumetric flow rate delivered by the peristaltic pump.

Seal wash pumps are commonly used to provide wash solvent to the seals and plungers of chromatography system pumps used to deliver a solvent to a chromatography column. In addition to removing particles and residues which might otherwise result in damage to the seals and plungers, the wash solvent acts as a lubricant at the seal and plunger interface. A volume of fresh wash solvent should be regularly provided to seals and pistons during operation to maintain proper operation and increase longevity of these components. Extended operation without wash solvent can result in significant wear to the seal and plunger.

In some liquid chromatography systems, the seal wash pump is a diaphragm pump. Due to variations in the pump stroke volume, the diaphragm pump may deplete the source of wash solvent faster than anticipated. Alternatively, a peristaltic pump may be used for the seal wash pump. While providing the significant benefit of self-priming, the peristaltic pump exhibits variations in volumetric delivery due to varying ambient temperature. As a result, wash solvent is consumed at different rates according to the ambient temperature. Generally, the peristaltic pump is less likely to overconsume wash solvent when compared to the diaphragm pump although, if operating at an elevated ambient temperature, the source of wash solvent may still be prematurely depleted thereby subjecting the seals and plunger to significant wear. Alternatively, underconsumption of wash solvent that can result during operation at lower ambient temperature generally avoids the problem of premature depletion of wash solvent; however, increased wear may result during operation.

SUMMARY

In one aspect, a method for regulating a volume of liquid delivered by a peristaltic pump includes sensing an ambient temperature of a peristaltic pump having a pump motor. One of a motor speed and a motor operation duration is determined for the pump motor based on the sensed ambient temperature, a selected volume of liquid to deliver and a predetermined correspondence of the motor speed to the ambient temperature to produce a volumetric flow rate from the peristaltic pump. The pump is operated at the determined motor speed or motor operation duration to deliver the selected volume of liquid from the peristaltic pump.

The predetermined correspondence of the motor speed to the ambient temperature may include previously acquired data indicating the motor speed used to produce the volumetric flow rate as a function of ambient temperature and as a function of a storage condition of the peristaltic pump.

The predetermined correspondence of the motor speed to the ambient temperature may include a mathematical fit to a plurality of data points representing the volumetric flow rate as a function of the ambient temperature. Each of the data points may represent the volumetric flow rate as an average of a volumetric flow rate for a stored condition and a volumetric flow rate for an unstored condition as a function of the ambient temperature.

The steps of sensing the ambient temperature, determining one of a motor speed and a motor operation duration and operating the pump motor at the determined motor speed or motor operation duration may be periodically repeated.

The operating of the pump motor may include periodically delivering a solvent pulse having the selected volume of liquid.

Determining one of a motor speed and a motor operation duration may include determining both the motor speed and the motor operation for the pump motor based on the sensed ambient temperature, the selected volume of liquid to deliver and the predetermined correspondence of the motor speed to the ambient temperature to deliver the selected volume of liquid from the peristaltic pump. The step of operating the pump motor may include operating the pump motor at the determined motor speed for the determined motor operation duration to deliver the selected volume of liquid from the peristaltic pump.

In another aspect, a peristaltic pump system includes a peristaltic pump having a pump motor, a temperature sensor, a memory module and a processor. The temperature sensor is disposed in an ambient environment of the peristaltic pump. The memory module is configured to store data defining a predetermined correspondence of a motor speed of the pump motor to the ambient temperature to produce a volumetric flow rate from the peristaltic pump. The processor is in communication with the peristaltic pump, the temperature sensor and the memory module. The processor is configured to determine the motor speed or a motor operation duration that delivers a selected volume of liquid from the peristaltic pump based on a temperature sensed by the temperature sensor and the predetermined correspondence of the motor speed of the pump motor to the ambient temperature. The processor is further configured to provide a control signal to the peristaltic pump to operate the pump motor at the determined motor speed or motor operation duration.

The data defining the predetermined correspondence between the motor speed and the ambient temperature may include coefficients of a mathematical fit to empirical data.

The peristaltic pump may include a pump controller in communication with the processor and the pump motor.

The processor may be configured to determine the motor speed and the motor operation duration that together deliver the selected volume of liquid from the peristaltic pump based on a temperature sensed by the temperature sensor and the predetermined correspondence of the motor speed of the pump motor to the ambient temperature. The processor may be further configured to provide the control signal to the peristaltic pump to operate the pump motor at the determined motor speed for the determined motor operation duration.

The peristaltic pump system may further include a user interface in communication with the processor and configured to receive the selected volume of liquid to be delivered by the peristaltic pump by user entry. The peristaltic pump system may further include a liquid chromatography pump having a seal wash compartment in communication with the peristaltic pump to receive a flow of a seal wash solvent therefrom. The peristaltic pump system may further include a source of wash solvent in communication with an inlet of the peristaltic pump.

BRIEF DESCRIPTION OF THE DRAWINGS

The above and further advantages of this invention may be better understood by referring to the following description in conjunction with the accompanying drawings, in which like numerals indicate like structural elements and features in the various figures. For clarity, not every element may be labeled in every figure. The drawings are not necessarily to scale, emphasis instead being placed upon illustrating the principles of the invention.

DETAILED DESCRIPTION

Figure 1:
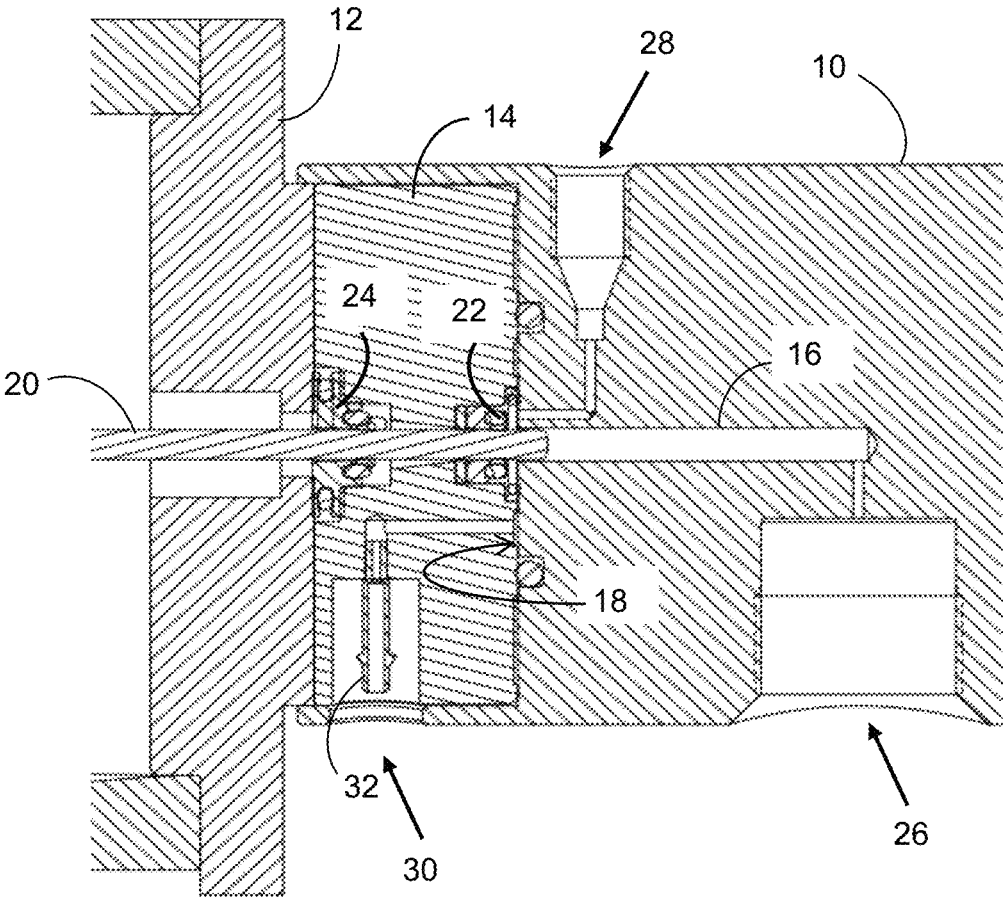
FIG. 1 is a cross-sectional illustration of a portion of a pump assembly.

Reference in the specification to an embodiment or example means that a particular feature, structure or characteristic described in connection with the embodiment or example is included in at least one embodiment or example of the teaching. References to a particular embodiment or example within the specification do not necessarily all refer to the same embodiment or example.

The present teaching will now be described in detail with reference to exemplary embodiments or examples thereof as shown in the accompanying drawings. While the present teaching is described in conjunction with various embodiments and examples, it is not intended that the present teaching be limited to such embodiments and examples. On the contrary, the present teaching encompasses various alternatives, modifications, and equivalents, as will be appreciated by those of skill in the art. For example, various examples described herein refer to solvents although it should be recognized that other fluids can be used. Those of ordinary skill having access to the teaching herein will recognize additional implementations, modifications, and embodiments, as well as other fields of use, which are within the scope of the present disclosure as described herein.

In brief overview, embodiments and examples disclosed herein are directed to a method for regulating a volume of liquid delivered by a peristaltic pump. According to embodiments, an ambient temperature of the peristaltic pump is sensed and at least one of a motor speed and a motor operation duration for the peristaltic pump is determined based on the sensed ambient temperature, a selected volume of liquid to deliver from the peristaltic pump and a predetermined correspondence of the motor speed to the ambient temperature. The pump is operated at the determined motor speed and/or the determined motor operation duration to deliver the selected volume of liquid from the peristaltic pump. The steps of sensing of the ambient temperature, determining the motor speed and/or motor operation duration and operating the pump motor at the determined motor speed or for the motor operation duration may be repeated so that the selected volume of liquid delivered by the peristaltic pump is maintained regardless of changes in the ambient temperature.

The peristaltic pump may be used as a seal wash pump for a high pressure liquid chromatography system (HPLC), an ultra-high-pressure liquid chromatography (UHPLC) system, or the like.

Implementations of the method disclosed herein allow fluid to be delivered by constant volume contributions regardless of changes in the ambient temperature. Advantageously, only a single temperature measurement is used and the temperature may be sensed by a temperature sensor that is also used for observation and/or control of other functions in the liquid chromatography system. Moreover, temperature monitoring of heat transfer paths and complicated modeling of heat transfer processes is not required to perform the method.

When implementing the method with a peristaltic wash solvent pump for a liquid chromatography system, the accurate dispensing of wash solvent makes prediction of when solvent depletion will occur more accurate. Thus, users can replenish wash solvent at predetermined times without premature replacement of the source of wash solvent or risk of wash solvent depletion prior to replacement.

FIG. 1 is a cross-sectional illustration of a portion of a pump assembly which includes a pump head 10 secured to a support plate 12. A seal wash housing 14 is disposed in a counterbore of the pump head 10 and abuts one side of the support plate 12. The pump head 10 includes a chamber 16 and a seal wash housing abutment surface 18. A plunger 20 extends through a bore of the seal wash housing 14 and into the chamber 16. The seal wash housing 14 includes a compartment to purge fluid and wash the plunger 20 of any particulate that may form on the plunger surface. A high-pressure seal assembly 22 and low-pressure seal assembly 24 act to contain fluids within their appropriate quarters. The high-pressure seal assembly 22 keeps fluid at high pressure (e.g., pressure that may exceed 140 MPa (20,000 psi)) from leaking into the seal wash housing 14 and other areas of the pump head 10 and the low-pressure seal assembly 24 keeps the wash fluid in the seal wash compartment defined between the two seals 22 and 24. As illustrated, both seal assemblies 22 and 24 are spring-assisted seals and reside in respective glands in the seal wash housing 14.

The pump head 10 further includes an inlet port 26 and an outlet port 28 through which fluid is received and discharged, respectively. The inlet port 26 joins the chamber 16 at the chamber remote end whereas the outlet port 28 is in fluidic communication with the other end of the chamber 16 through a seal cavity defined at the high-pressure seal 22. The intake of fluid into the pump head 10 occurs in response to the plunger 20 moving within the chamber 16 in a rearward direction (to the left) and the transfer of pressurized fluid out of the pump head 10 occurs in response to the plunger 20 moving in a forward direction (to the right) further into the chamber 16.

A seal wash pump (not shown) provides wash solvent to the seal wash compartment. In addition to removing particles and residues which might otherwise result in damage to the seals 22 and 24 and plunger 20, the wash solvent acts as a lubricant at the interface of the seals 22 and 24 with the plunger 20. Wash solvent is regularly provided during operation of the chromatography system to maintain proper operation as well as to reduce wear and increase the lifetime of the seal assemblies 22 and 24 and plunger 20. The wash solvent is delivered to and discharged from the pump via respective wash solvent ports 30 (only one visible in figure). In the illustrated example, tubing to conduct the was solvent may be coupled to a barbed fitting 32 although alternative coupling elements may instead be used.

It should be recognized that the use of a peristaltic pump for providing a seal wash solvent in a liquid chromatography system does not require a continuous flow of wash solvent. Instead, the pump may be periodically operated to deliver a solvent pulse. For example, the solvent pulse may have a duration of approximately one second or less and be provided once every several minutes. In a specific non-limiting numerical example, the wash solvent pump may deliver a 75 μL solvent pulse once every five minutes.

The seal wash pump may be a peristaltic pump which provides advantages over other types of pumps. For example, a peristaltic pump has self-priming capability whereas other pumps such as diaphragm pumps do not and therefore require additional time and effort at startup.

Tubing utilized by peristaltic pumps is generally affected by both temperature and the time that the pump, or at least the tubing for the pump, has been in storage (i.e., the "storage condition.") For example, the tubing generally becomes stiffer with decreasing temperature and more compressible with increasing temperature.

Figure 2:
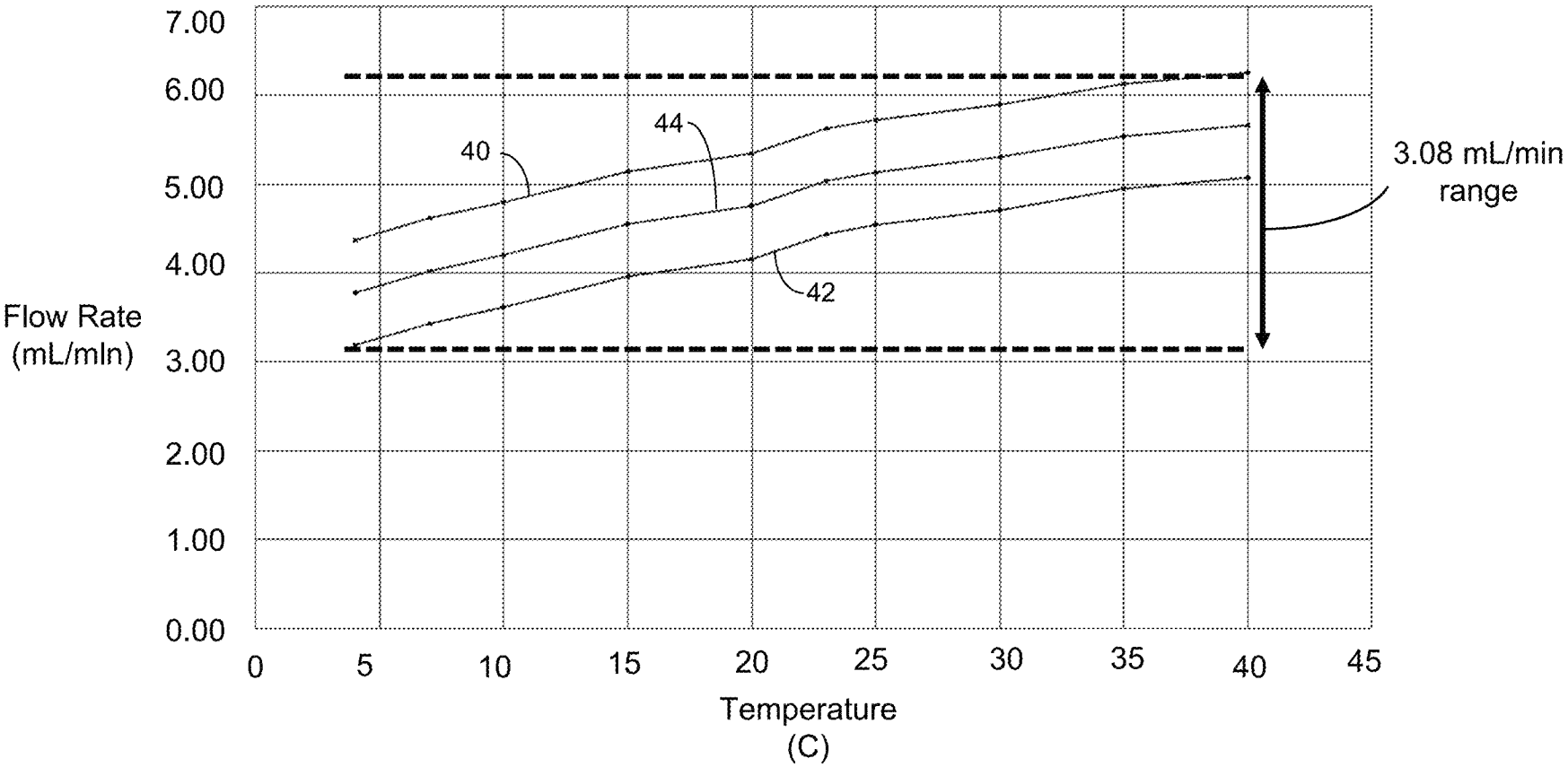
FIG. 2 is a graphical representation of the volumetric flow rate from a peristaltic pump as a function of temperature and storage condition.

FIG. 2 graphically depicts the volumetric flow rate from an exemplary peristaltic pump as a function of temperature and storage condition. Plot 40 represents the volumetric flow rate of a WPM1 series peristaltic pump (available from Welco Co., Ltd. of Tokyo, Japan) as a function of ambient temperature where the pump tubing is in an unstored condition, i.e., is in its manufactured state when first set up for use. The plot 40 shows that the volumetric flow rate of the delivered solvent increases with increasing ambient temperature. For example, a pump at 20° C. may be programmed to provide a volumetric flow rate of 5.4 mL/min. If the programmed volumetric flow rate remains unchanged, the pump will provide a lower flow rate (about 4.4 mL/min at 4° C.) at lower ambient temperatures and a higher flow rate (about 6.2 mL/min at 40° C.) at higher ambient temperatures. If the pump is subjected to long term storage (e.g., a month or more), particularly at higher storage temperatures, the actual volumetric flow rate is observed to be less. For example, the pump may undergo a thermo-oxidation degradation during storage. Plot 42 represents the volumetric flow rate of the same peristaltic pump for a stored condition. In this case, the stored condition corresponded to a cycling of temperature between −30° C. and 60° C. for a duration of 5.5 days. If the pump is stored long enough, no further change to the volumetric flow rate is observed as no further degradation occurs.

Measurements used to generate the plots 40 and 42 were taken before and after storage conditions. The average reduction in flow rate after storage for all specimens was calculated and the result subtracted from the unstored condition plot 40 to generate plot 42. Plot 44 represents an average of plots 40 and 42 and demonstrates an intermediate performance between the "new" (unstored) and "heavily stored" conditions.

The maximum difference in the volumetric flow rates, as defined for an unstored pump at 40° C. and an after storage pump at 4° C., is approximately 3.08 mL/min. Thus, the delivered volumetric flow rate for a peristaltic pump operated within an ambient temperature range between 4° C. and 40° C. may instead deliver a volumetric flow rate that can differ by up to 3.08 mL/min.

Figure 3A:
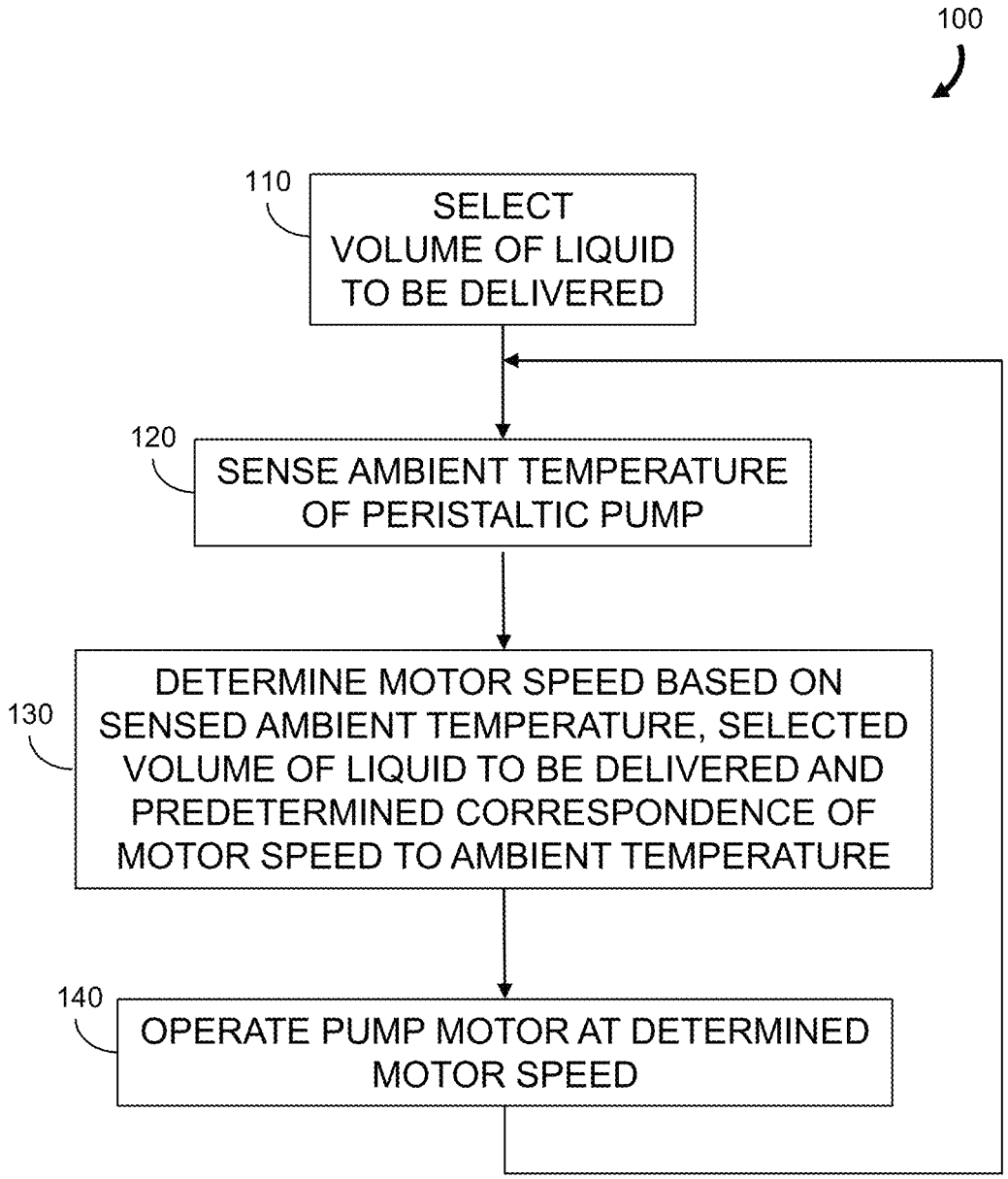
FIG. 3A is a flowchart representation of an embodiment of a method for regulating a volume of liquid delivered by a peristaltic pump.
Figure 4:
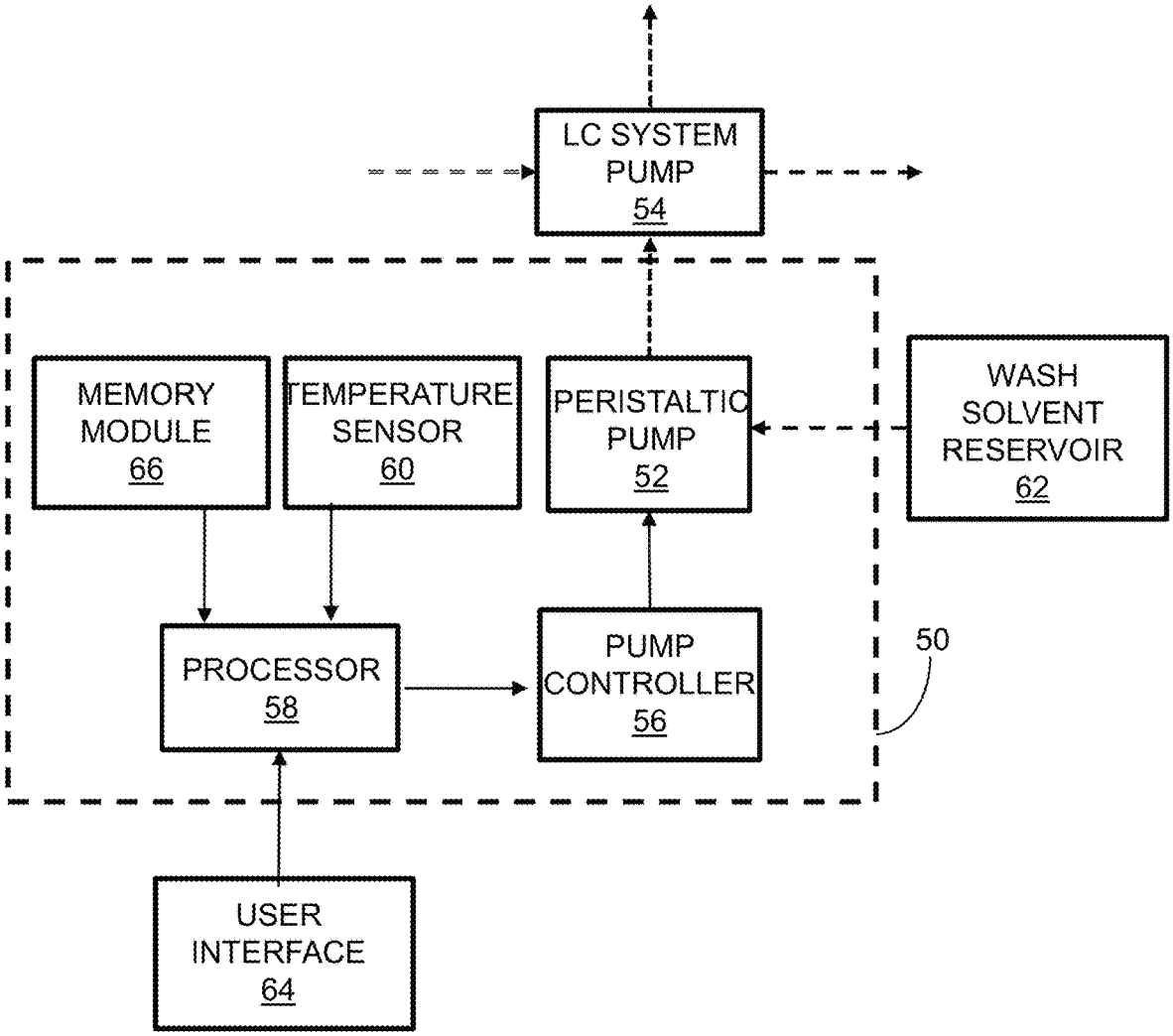
FIG. 4 is a block diagram of a pump system that may be used to perform the method of FIG. 3.

FIG. 3A is a flowchart representation of an example of a method 100 for regulating a volume of liquid delivered by a peristaltic pump and FIG. 4 is a block diagram of an example of a pump system 50 that may be used to perform the method 100. The pump system 50 includes a peristaltic pump 52 suitable for coupling to a liquid chromatography system pump 54. The peristaltic pump 52 includes a motor that has a controllable motor speed to enable changes to the volumetric flow rate. The pump system 50 further includes a pump controller 56, processor 58, memory module 66 and temperature sensor 60. A wash solvent reservoir 62 is provided as a source of wash solvent and is coupled to an inlet of the peristaltic pump 52. A user interface 64 is provided to enable a user to define operating conditions for the wash solvent pump 52 as well as to monitor various operating parameters. The user interface 64 may be part of an interface used for operation of the liquid chromatography system. The processor 58 may operate on data provided by the user through the user interface 64 and other data received from the pump controller 56, temperature sensor 60 and memory module 66. In addition, the processor 58 may determine and provide control data to the pump controller 56 to operate the wash solvent pump 52 in the desired manner. For example, the processor 58 may receive and transmit data by way of analog and/or digital signals as is known in the art and may utilize the memory module 66 for storage and retrieval of data used in various calculations. The processor 58 is adapted to perform calculations based on received data to determine a motor speed for the wash solvent pump 52 as described in more detail below.

According to the method 100, a volume of liquid to be delivered is selected (110) by a user. For example, the user may enter the desired volume through the user interface 64 or a default volume may be used. In one example in which the period of operation of the pump motor (i.e., "motor operation duration") is maintained at a fixed value regardless of temperature, a user may instead select a volumetric flow rate to be delivered by the peristaltic pump. In this alternative, the volume of liquid to be delivered is defined by the product of the motor operation duration and the desired volumetric flow rate. The method 100 continues by sensing (120) the ambient temperature of the peristaltic pump 52. In some embodiments, the temperature sensor 60 is a shared sensor that is used to control other aspects of the liquid chromatography system that are dependent on temperature. Examples of temperature sensors that may be used include thermistors and thermocouples. Alternatively, an ambient temperature sensor printed circuit board may be used. In some instances, more than one temperature sensor may be used, and an average of the sensed values calculated to determine the ambient temperature. It is assumed that the ambient temperature to the peristaltic pump is nominally the same as the temperature at the location of the temperature sensor 60 although this is not required if variations in temperature at the wash solvent pump 52 accurately track the variations in temperature at the location of the temperature sensor 60.

The method 100 further includes determining (130) a motor speed for the peristaltic pump 52 based on the sensed ambient temperature, the selected volume of liquid to be delivered (or selected volumetric flow rate) and a predetermined correspondence of the motor speed to the ambient temperature to produce the selected volume of liquid to be delivered from the peristaltic pump 52. An empirically derived relationship for volumetric flow rate as a function of ambient temperature, as depicted by example in FIG. 2, can be used for the determination (130) of the motor speed. The pump motor is then operated (140) at the determined motor speed. The method 100 may continue by repeating steps 120 through 140. For example, the repetition may occur periodically. Preferably, the sensing (120) of ambient temperature occurs at a rate that is substantially greater than the highest frequency of ambient temperature fluctuations. By way of a non-limiting example, the temperature may be sensed at least once per minute for environments where the ambient temperature is not well controlled while the temperature may be sensed only a few times per hour in a well-controlled environment (e.g., ambient temperature variations less than 1° C.). Advantageously, the peristaltic pump is controlled to deliver the same volume of liquid regardless of the ambient temperature.

Figure 3B:
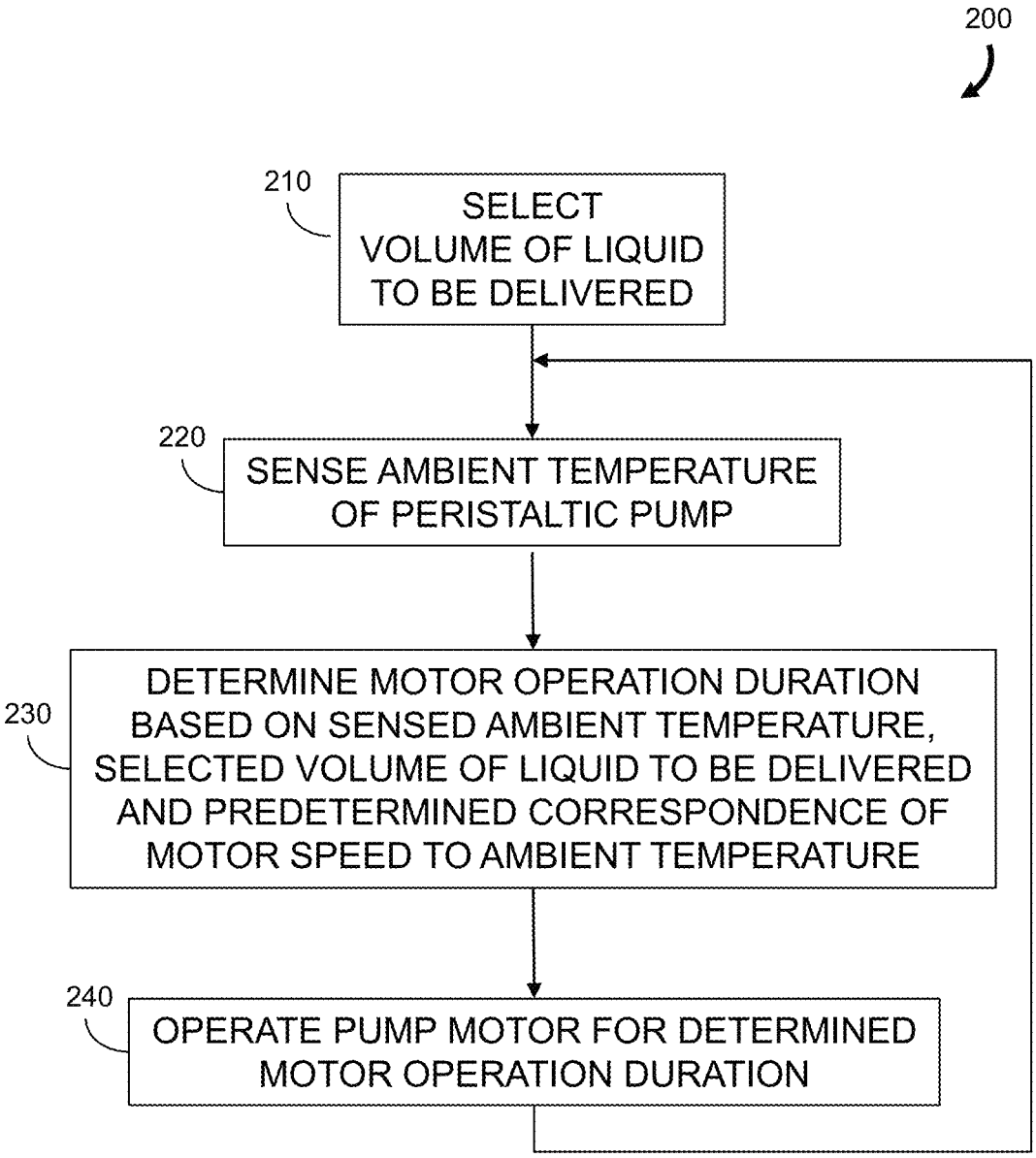
FIG. 3B is a flowchart representation of another embodiment of a method for regulating a volume of liquid delivered by a peristaltic pump.

FIG. 3B is a flowchart representation of an alternative example of a method 200 for regulating a volume of liquid delivered by a peristaltic pump. The method 200 may be performed with the pump system 50 of FIG. 4. According to the method 200, a desired volume of liquid to be delivered is selected (210) by a user. The method 200 continues by sensing (220) the ambient temperature of the peristaltic pump 52. In this method 200, the motor operates at a fixed (predetermined) motor speed regardless of the ambient temperature and a motor operation duration for the peristaltic pump 52 is determined (230) from the sensed ambient temperature, the selected volume of liquid to be delivered and the predetermined correspondence of the motor speed to the ambient temperature to produce the selected volume of liquid. The empirically derived relationship for volumetric flow rate as a function of ambient temperature, as depicted by example in FIG. 2, can be used to determine the motor operation duration. The pump motor then operates (240) for a period of time equal to the determined motor operation duration. The method 200 may repeat steps 220 through 240. Thus, the peristaltic pump is controlled to deliver the same volume of liquid regardless of changes in the ambient temperature.

In another example of a method for regulating a volume of liquid delivered by a peristaltic pump, active control of both motor speed and motor operation duration may be used. Thus, the method determines the values of the two variables to control the delivered volume of liquid. This example method may be beneficial when one of the variables is limited by its operational range and may otherwise provide insufficient ability to enable the desired operation.

Figure 5:
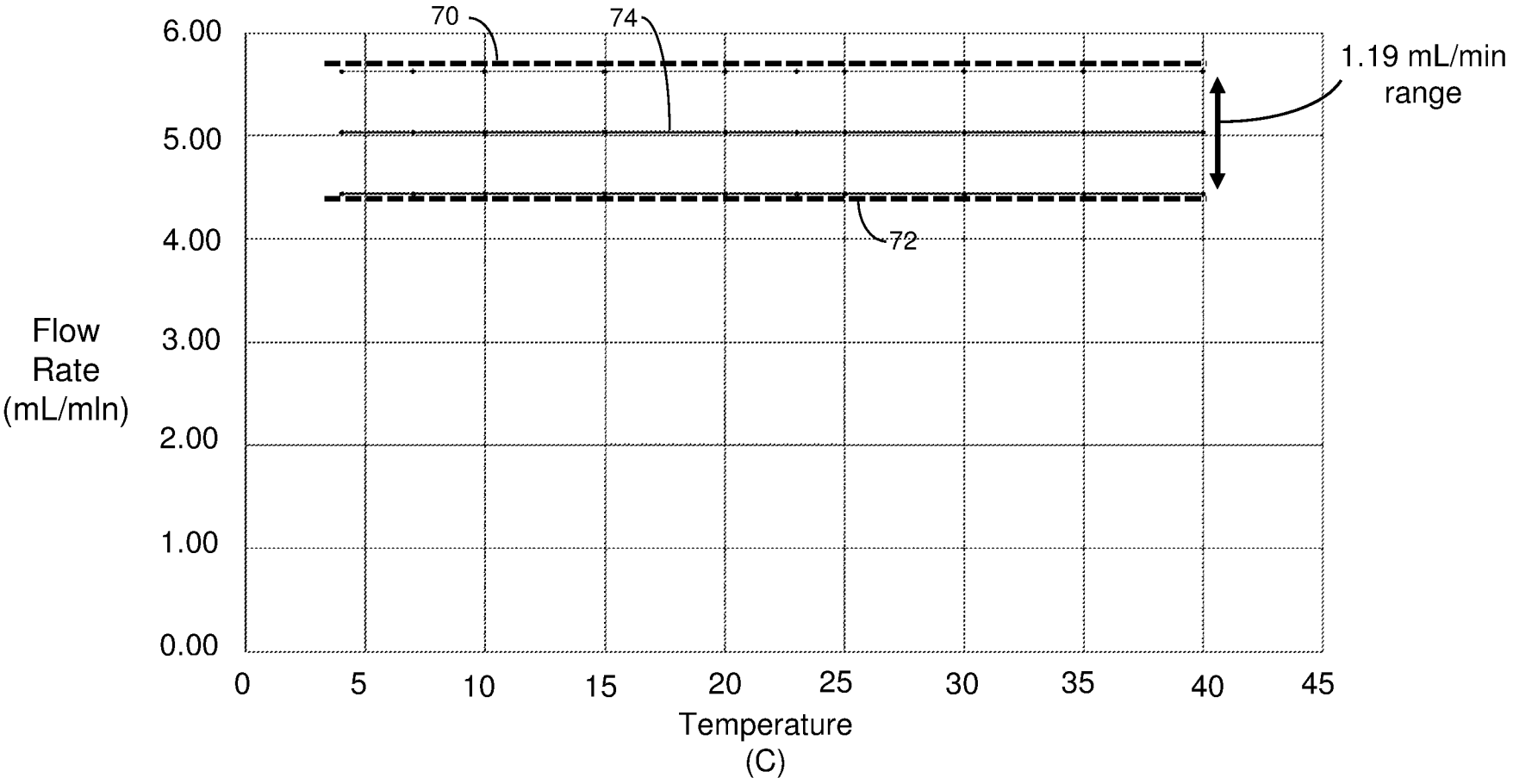
FIG. 5 is a graphical representation of the volumetric flow rate from a peristaltic pump as a function of temperature and storage condition for operation according to the method of FIGS. 3A and 3B.

FIG. 5 graphically depicts the volumetric flow rate from the peristaltic pump as a function of temperature and storage condition for a peristaltic pump operated according to the method 100 described above. Plots 70, 72 and 74 correspond to plots 40, 42 and 44, respectively, of FIG. 2 where temperature dependence has been removed; however, the 1.19 mL/min offset between the different storage conditions remains. Thus, a peristaltic pump operated according to the method 100 may deliver a different volume of liquid than the selected value due to the variance in the volumetric flow rates; however, the difference in the volumetric flow rates will not exceed 1.19 mL/min and the delivered volumetric flow rate does not change even if the ambient temperature differs significantly within the plotted temperature range. For estimating solvent consumption, the middle plot 44 may serve as an average of the unstored and stored conditions and can be used so that the maximum error in the estimate of the volumetric flow rate is limited to less than 0.60 mL/min. If the storage condition of the pump is known, it is possible to make a more accurate estimate. Consequently, a user can be presented with an estimate of wash solvent usage that is significantly more accurate and underconsumption or overconsumption of wash solvent is reduced.

Referring again to FIG. 2, the previously acquired data points used to generate the plot 44 (the midrange plot based on plots 40 and 42) can be mathematically fit to a curve. The equation for the plot 44 is derived and represents a delivered volumetric flow rate across a continuous range of ambient temperatures. For example, the data can be fit to a second order polynomial $$y=Ax^2+Bx+C \tag{1}$$

where x is the ambient temperature and y is the volumetric flow rate although other order polynomials can be used according to the desired precision. For the data shown in the figure, A=−0.0006, B=0.0812 and C=3.4662. For other peristaltic pumps, the volumetric flow rate data as a function of ambient temperature will generally be different due to differences in the inner diameter, wall thickness and/or tubing material composition. Consequently, different values of A, B and C are determined.

Using the above coefficients determined for the data fit example, equation (1) can be expressed in terms of motor velocity with $1/16^{th}$ stepping as $$4977.77y=-0.0006x^2+0.0812x+3.4662. \tag{2}$$

The value 4,977.77 is a constant that is based on the characteristics of the stepper motor and is used to multiply the volumetric flow rate in mL/min into motor velocity in $1/16^{th}$ steps to obtain the corresponding rate in μsteps/s.

It will be recognized that the relationship expressed by equation (2) will be different for different types of stepper motors. More specifically, the value of 4,977.77 will be different to account for the different step size with respect to angular displacement of the motor shaft for the different motors. Moreover, other types of motors may be used, such as brushless DC motors.

Advantageously, a peristaltic pump controlled according to embodiments and examples of the method described herein result in a rate of wash solvent consumption that is independent of ambient temperature. Consequently, estimates of solvent consumption rate provided to a user are more accurate and the amount of overconsumption or underconsumption are substantially reduced.

While various examples have been shown and described, the description is intended to be exemplary, rather than limiting and it should be understood by those of ordinary skill in the art that various changes in form and detail may be made therein without departing from the scope of the invention as recited in the accompanying claims.

What is claimed is:

1. A method for regulating a volume of liquid delivered by a peristaltic pump, the method comprising:

sensing an ambient temperature of a peristaltic pump having a pump motor;

determining one of a motor speed and a motor operation duration for the pump motor based on the sensed ambient temperature, a selected volume of liquid to deliver and a predetermined correspondence of the motor speed to the ambient temperature to produce a volumetric flow rate from the peristaltic pump, wherein the predetermined correspondence of the motor speed to the ambient temperature comprises previously acquired data indicating the motor speed used to produce the volumetric flow rate as a function of ambient temperature and as a function of a storage condition of the peristaltic pump; and operating the pump motor at the determined motor speed or motor operation duration to deliver the selected volume of liquid from the peristaltic pump.

2. The method of claim 1 wherein the predetermined correspondence of the motor speed to the ambient temperature comprises a mathematical fit to a plurality of data points representing the volumetric flow rate as a function of the ambient temperature.

3. The method of claim 2 wherein each of the data points represents the volumetric flow rate as an average of a volumetric flow rate for a stored condition and a volumetric flow rate for an unstored condition as a function of the ambient temperature.

4. The method of claim 1 wherein the steps of sensing the ambient temperature, determining one of a motor speed and a motor operation duration and operating the pump motor at the determined motor speed or motor operation duration are periodically repeated.

5. The method of claim 1 wherein the operating of the pump motor comprises periodically delivering a solvent pulse having the selected volume of liquid.

6. The method of claim 1 wherein determining one of a motor speed and a motor operation duration comprises determining the motor speed and the motor operation for the pump motor based on the sensed ambient temperature, the selected volume of liquid to deliver and the predetermined correspondence of the motor speed to the ambient temperature to deliver the selected volume of liquid from the peristaltic pump.

7. The method of claim 6 wherein the step of operating the pump motor comprises operating the pump motor at the determined motor speed for the determined motor operation duration to deliver the selected volume of liquid from the peristaltic pump.

8. A peristaltic pump system comprising:

a peristaltic pump having a pump motor;

a temperature sensor disposed in an ambient environment of the peristaltic pump;

a memory module configured to store data defining a predetermined correspondence of a motor speed of the pump motor to the ambient temperature to produce a volumetric flow rate from the peristaltic pump; and a processor in communication with the peristaltic pump, the temperature sensor and the memory module, the processor configured to determine the motor speed or a motor operation duration that delivers a selected volume of liquid from the peristaltic pump based on a temperature sensed by the temperature sensor and the predetermined correspondence of the motor speed of the pump motor to the ambient temperature, wherein the predetermined correspondence of the motor speed to the ambient temperature comprises previously acquired data indicating the motor speed used to produce the volumetric flow rate as a function of ambient temperature and as a function of a storage condition of the peristaltic pump, the processor further configured to provide a control signal to the peristaltic pump to operate the pump motor at the determined motor speed or motor operation duration.

9. The peristaltic pump system of claim 8 wherein the peristaltic pump comprises a pump controller in communication with the processor and the pump motor.

10. The peristaltic pump system of claim 8 further comprising a user interface in communication with the processor and configured to receive the selected volume of liquid to be delivered by the peristaltic pump by user entry.

11. The peristaltic pump system of claim 8 wherein the data defining the predetermined correspondence between the motor speed and the ambient temperature comprises coefficients of a mathematical fit to empirical data.

12. The peristaltic pump system of claim 8 further comprising a liquid chromatography pump having a seal wash compartment in communication with the peristaltic pump to receive a flow of a seal wash solvent therefrom.

13. The peristaltic pump system of claim 8 further comprising a source of wash solvent in communication with an inlet of the peristaltic pump.

14. The peristaltic pump system of claim 8, wherein the processor is configured to determine the motor speed and the motor operation duration that together deliver the selected volume of liquid from the peristaltic pump based on a temperature sensed by the temperature sensor and the predetermined correspondence of the motor speed of the pump motor to the ambient temperature.

15. The peristaltic pump system of claim 14, wherein the processor is further configured to provide the control signal to the peristaltic pump to operate the pump motor at the determined motor speed for the determined motor operation duration.

* * * * *